US006680288B1

(12) United States Patent
Groot et al.

(10) Patent No.: US 6,680,288 B1
(45) Date of Patent: Jan. 20, 2004

(54) PROCESS FOR PREPARING GRANULAR DETERGENT COMPOSITIONS

(75) Inventors: Andreas Theodorus Groot, Vlaardingen (NL); Roland Wilhemus van Pomeren, Vlaardingen (NL)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 167 days.

(21) Appl. No.: 09/718,468

(22) Filed: Nov. 21, 2000

(30) Foreign Application Priority Data

Nov. 22, 1999 (GB) ..... 9927653

(51) Int. Cl.[7] ..... C11D 11/00

(52) U.S. Cl. ..... 510/444; 510/509; 510/510; 23/313 FB

(58) Field of Search ..... 510/444, 276, 510/509, 510, 313 FB

(56) References Cited

U.S. PATENT DOCUMENTS

| | | | | | |
|---|---|---|---|---|---|
| 3,650,961 | A | * | 3/1972 | Hudson | 510/530 |
| 3,714,051 | A | | 1/1973 | Milesi et al. | 252/135 |
| 3,989,635 | A | * | 11/1976 | Toyoda et al. | 510/442 |
| 4,427,417 | A | * | 1/1984 | Porasik | 23/313 R |
| 5,576,285 | A | * | 11/1996 | France et al. | 510/444 |
| 5,610,131 | A | * | 3/1997 | Donoghue et al. | 510/444 |
| 5,707,958 | A | * | 1/1998 | Mallari et al. | 510/444 |
| 5,736,502 | A | * | 4/1998 | Wilkinson | 510/444 |
| 5,916,868 | A | * | 6/1999 | Mazzola et al. | 510/444 |
| 5,929,021 | A | * | 7/1999 | Dhanuka et al. | 510/444 |
| 6,056,905 | A | * | 5/2000 | Akkermans et al. | 264/117 |
| 6,077,820 | A | * | 6/2000 | Dhanuka et al. | 510/444 |
| 6,133,223 | A | * | 10/2000 | Sampaio et al. | 510/444 |
| 6,150,323 | A | * | 11/2000 | Del Greco et al. | 510/444 |
| 6,274,544 | B1 | * | 8/2001 | Akkermans et al. | 510/444 |

FOREIGN PATENT DOCUMENTS

| | | |
|---|---|---|
| DE | 195 46 735 | 6/1997 |
| DE | 196 11 014 | 9/1997 |
| EP | 367 339 | 5/1990 |
| EP | 420 317 | 4/1991 |
| EP | 643 129 | 3/1995 |
| WO | 96/04359 | 2/1996 |
| WO | 97/22685 | 6/1997 |
| WO | 97/34991 | 9/1997 |
| WO | 98/58046 | 12/1998 |
| WO | 98/58047 | 12/1998 |
| WO | 98/58048 | 12/1998 |
| WO | 99/00475 | 1/1999 |

* cited by examiner

*Primary Examiner*—Lorna M. Douyon
(74) *Attorney, Agent, or Firm*—Rimma Mitelman

(57) ABSTRACT

A process for preparing a free-flowing granular detergent composition with improved storage stability involves granulation of a solid starting material comprising a hydratable salt with a liquid binder and treating the resulting granules in a low shear mixer with from 0.5 to 20 wt % of water.

7 Claims, No Drawings

PROCESS FOR PREPARING GRANULAR DETERGENT COMPOSITIONS

FIELD OF THE INVENTION

The present invention relates to a process for preparing a free-flowing, storage-stable granular detergent composition. More particularly, the invention is directed to a process involving granulation of a particulate material with a liquid binder and treating the resulting granules with an amount of water.

BACKGROUND OF THE INVENTION

The handling and storage properties of modern detergent powders have gained increasing importance in recent years. The detergent industry has been put under increasing pressure to satisfy both external consumer demands and expectations, and in addition, internal demands to cut the cost of production and to improve the management of manufacturing and supply chain.

An important criterion in the management of manufacturing and supply chain is the ability to handle and store powders. A serious problem which can arise during storage is caking of the powder, for example in big bags or silos. This can lead to hold-ups in the supply chain, and, if the powder has deteriorated to a significant degree, the discarding of the powder.

Therefore, it is very important that powders are free-flowing and do not cake upon storage (i.e. they should not be "sticky"). It is also important that powders do not contain a significant amount of fine particles as large levels of fines can have a deleterious effect of the flow-properties of a powder. Furthermore, fines have a tendency to "settle", aggregating at the bottom of, for example, a storage vessel. Conventionally, detergent compositions have been produced by a spray-drying process in which the components of the composition are mixed with water to form an aqueous slurry which is then sprayed into a tower and contacted with hot air to remove water. In recent years, there has been much interest in the production of detergent products produced by processes which employ non-spray-drying ("non-tower") techniques. In these type of processes, the various components are generally mixed, for example by mechanical agitation or gas fluidisation, and granulated with the addition of a liquid binder. Liquid binders typically used in such granulation processes are anionic surfactants, acid precursors of anionic surfactants, nonionic surfactants, fatty acids or salts thereof, water or any mixture thereof.

Spray-drying tends to produce dry, relatively non-sticky powders. In contrast, powders produced by non-tower granulation techniques tend to be much more sensitive to problems of stickiness and caking upon storage. The amount of liquid binder added in a non-tower granulation process usually represents an important factor in determining the quality of the product. Too much binder can lead to lumping and a sticky product, and too little can lead to incomplete granulation.

There are several well-known techniques which manufacturers use to help prevent powders caking and lumping, and also to aid the flow properties of powders. For example, it is well-known to coat sticky or moist granules with a finely divided solid such as an aluminosilicate. This is often referred to as "layering".

Granulated powders are also often put through a drying step in order to improve their flow and storage properties.

However, the very step of drying can create problems in itself. During drying, depending on the absorbency of the solid components and on the nature of the liquid constituents, the liquid binder constituents can become mobile and start to move to the surface of, and eventually bleed from, the granulates. This can lead to caking and lumping both during the drying process and upon storage of the powder.

We have found that powders produced by non-tower processes and containing a hydratable salt, such as for example a phosphate detergency builder such as sodium tripolyphosphate (STPP), are prone to problems of "stickiness", leading to reduced flowability, and caking upon storage. Furthermore, "drying" and layering do not automatically produce "non-sticky" powders with good flow properties. Hence there is still a need for cost-effective methods for improving the handling and storage properties of these powders.

PRIOR ART

W097/34991 (Henkel) describes a processes for the manufacture of detergent powders in which water is used as a granulation aid. According to this document, the risk of lumping and bleeding of any nonionic surfactant, even during the drying stage is minimised by treating the granulated product either before or during drying with an aqueous solution or an aqueous dispersion of one or more non-surfactant washing- or cleaning agent constituents. The resulting powders are free flowing, do not cake and have good storage stability. The aqueous solution contains 25–50, preferably 30–40 wt % of the non-surfactant washing- or cleaning agent, for example sodium silicate, and is used in amounts of 1–15, preferably 2–8 wt %.

It is also known to spray an aqueous solution of nonionic surfactant into a fluid bed granulator during the granulation process, as disclosed in U.S. Pat. No. 3,714,051.

EP-A-0 643 129 discloses a process in which detergent composition ingredients are granulated in a process in which the components are mixed in a high shear mixer followed by a moderate speed mixer, wherein water is sprayed on at the rear of the moderate speed mixer, followed by dosing of a zeolite layering agent.

We have now found a simpler and cheaper method of improving the handling and storage properties of powders containing a hydratable salt. Surprisingly, we have found that the handling and storage properties of such powders can be improved merely by treating the product of a granulation process with an amount of water. More specifically, we have found that powders with very good flow properties, low levels of fines and a low level of "stickiness" can be obtained from the process of the present invention.

DEFINITION OF THE INVENTION

In a first aspect, this invention provides a process for preparing a granular detergent product in which a particulate material comprising a hydratable salt is granulated with a liquid binder, characterised in that the resulting granules are treated in a low shear mixer with from 0.5 to 20 wt % of water, based on the total amount of untreated granules, in such a manner that little or no further agglomeration takes place.

In a second aspect, this invention provides a granular detergent product obtained according to the process of the invention.

DETAILED DESCRIPTION OF THE INVENTION

Definitions

Hereinafter, in the context of this invention, the term "granular detergent product" encompasses granular finished products for sale, as well as granular components or adjuncts for forming finished products, e.g. by post-dosing to or with, or any other form of admixture with further components or adjuncts. Thus a granular detergent product as herein defined may, or may not contain detergent-active material such as synthetic surfactant and/or soap. The minimum requirement is that it should contain at least one material of a general kind of convenbonal component of granular detergent products, such as a surfactant (including soap), a builder, a bleach or bleach-system component, an enzyme, an enzyme stabiliser or a component of an enzyme stabilising system, a soil anti-redeposition agent, a fluorescer or optical brightener, an anti-corrosion agent, an anti-foam material, a perfume or a colourant.

However, in a preferred embodiment of this invention granular detergent products contain detergent-active material such as synthetic surfactant and/or soap at a level of at least 5 wt %, preferably at least 10 wt % of the product.

As used hereinafter, the term "powder" refers to materials substantially consisting of grains of individual materials and mixtures of such grains. As used hereinafter, the term "granule" refers to a small particle of agglomerated smaller particles, for example, agglomerated powder particles. The final product of the process according to the present invention consists of, or comprises a high percentage of granules. However, additional granular and or powder materials may optionally be post-dosed to such a product.

As used herein, the terms "granulation" and "granulating" refer to a process in which, amongst other things, particles are agglomerated.

For the purposes of this invention, the flow properties of the granular product are defined in terms of the dynamic flow rate (DFR), in ml/s, measured by means of the following procedure. A cylindrical glass tube of internal diameter of 35 mm and length of 600 mm is securely clamped with its longitudinal axis in the vertical position. Its lower end is terminated by a cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate, the outlet orifice is temporarily closed and the cylinder filled with the granular detergent product to a point about 10 cm above the upper sensor. The outlet is opened and the flow time t (seconds) taken for the powder level to fall from the upper sensor to the lower sensor measured electronically. This is repeated 2 or 3 times and an average time taken. If V is the volume (ml) of the tube between the upper and lower sensors, the DFR is given by V/t.

The unconfined compressibility test (UCT) provides a measure of the cohesiveness or "stickiness" of a product and can provide a guide to its storage properties in, for example, silos. The principle of the test is to compress the granular detergent product into a compact and then measure the force required to break the compact. This is carried out using an apparatus comprising a cylinder of diameter 89 mm and height 114 mm (3.5×4.5 inches), a plunger and plastic discs and weights of predetermined weight as follows.

The cylinder, positioned around a fixed locating disc and secured with a clamp, is filled with granular detergent product and the surface leveled by drawing a straight edge across it. A 50 g plastic disc is placed on top of the granular product, the plunger lowered and a 10 kg weight placed slowly on top of the upper plunger disc. The weight is left in position for 2 minutes after which time the 10 kg weight is removed and plunger raised. The clamp is removed from the cylinder and the two halves of the cylinder carefully removed to leave a compact of granular product. If the compact is unbroken, a second 50 g plastic disc is placed on top of the first and left for approximately ten seconds. If the compact is still unbroken, a 100 g disc is placed on top to the plastic discs and left for ten seconds. If the compact is still unbroken, the plunger is lowered very gently onto the discs and 250 g weights added at ten second intervals until the compact collapses. The total weight of plunger, plastic discs and weights at collapse is recorded.

The cohesiveness of the powder is classified by the weight required to break the compact as follows. The greater the weight required, the higher the UCT value and the more cohesive ("sticky") the powder.

As used herein, unless stated explicitly to the contrary, the term "fines", refers to particles with a diameter of less than 180 microns. Further, reference to "coarse" material, means particles with a diameter greater than 1400 microns.

Levels of fine and coarse particles can be measured using sieve analysis.

Unless specified otherwise, values relating to powder properties such as bulk density, DFR, moisture content etc. relate to the weathered granular detergent product.

DETAILED DESCRIPTION OF THE INVENTION

The process of the present invention comprises granulating a particulate material comprising a hydratable salt with a liquid binder.

Granulation

In the process according to the invention, conventional solid and liquid constituents of detergent compositions are mixed and granulated in a conventional manner, it being possible to use any known mixer, granulator and/or compactor. Hereinafter, the word "granulator" is used to refer to any suitable piece of equipment capable of granulating.

It is also possible to carry out the granulation step in two or more successive mixers which may have different mixing speeds and/or operate in quite different manners, e.g. mixers which work by mechanical agitation can be combined with low shear mixers, e.g. of the gas fluidisation kind.

Examples of appropriate granulation processes are described in EP 367339, EP 420317, W096/04359, W098/58046 and W098/58047 (Unilever), but other granulation processes are equally as appropriate as will be evident to the person skilled in the art.

In a preferred embodiment, the only granulator, or the last granulator if more than one mixer is employed, is a low shear mixer, preferably of the gas fluidisation kind. A gas fluidisation granulator is sometimes called a "fluidised bed" granulator or mixer. This is not strictly accurate since such mixers can be operated with a gas flow rate so high that a classical "bubbling" fluid bed does not form.

The gas fluidisation apparatus basically comprises a chamber in which a stream of gas (hereinafter referred to as the fluidisation gas), usually air, is used to cause turbulent flow of particulate solids to form a "cloud" of the solids and liquid binder is sprayed onto or into the cloud to contact the individual particles. As the process progresses, individual particles of solid starting materials become agglomerated, due to the liquid binder, to form granules.

The gas fluidisation granulator is typically operated at a superficial air velocity of about 0.1–1.5 $ms^{-1}$, preferably 0.1 to 1.2 $ms^{-1}$, either under positive or negative relative pressure and with an air inlet temperature (i.e. fluidisation gas temperature) ranging from −10° C. or 5° C. up to 100° C. It may be as high as 200° C. in some cases.

The fluidisation gas temperature, and thus preferably the bed temperature, may be changed during the granulation process as described in W098/58048. It may be elevated for a first period, e.g. at up to 100° C. or even up to 200° C. and then at one or more other stages (before or after), it may be reduced to just above, at, or below ambient, e.g. to 30° C. or less, preferably 25° C. or less or even as low as 5° C. or less or −10° C. or less.

When the process is a batch process, the temperature variation will be effected over time. If it is a continuous process, it will be varied along the direction of powder flow in the granulator bed. In the latter case, this is conveniently effected using a granulator of the "plug flow" type, i.e. one in which the materials flow through the reactor from beginning to end.

In a batch process, the fluidisation gas temperature may be reduced over a relatively short period of time, for example 10 to 50% of the process time. Typically, the gas temperature may be reduced for 0.5 to 15 minutes. In a continuous process, the gas temperature may be reduced along a relatively short length of the "track" of the granulator bed, for example along 10 to 50% of the track. In both cases, the gas may be pre-cooled.

Preferably, the fluidisation gas temperature, and preferably also the bed temperature, is not lowered until agglomeration of the fluidising particulate solid material is substantially complete.

In addition to the fluidisation gas, a gas fluidisation granulator may also employ an atomising gas stream. Such an atomising gas stream is used to aid atomisation of the liquid binder from the nozzle onto or into the fluidising solids. The atomising gas stream, usually air, may also be heated.

As used herein, the term "bed temperature" refers to the temperature of the fluidising solid particulate material. The temperature of the fluidising solid particulate material can be measured, for example, using a thermocouple probe. Whether there is a discernible powder bed or no discernible powder bed (i.e. because the mixer is being operated with a gas flow rate so high that a classical "bubbling" fluid bed is not formed), the "bed temperature" is taken to be the temperature as measured at a point inside the fluidisation chamber about 15 cm from the gas distributor plate.

The gas fluidisation granulator may optionally be of the kind provided with a vibrating bed, particularly for use in continuous mode.

Water Addition

Once granulation is substantially complete, the resulting granules are treated with from 0.5 to 20 wt % of water in a low shear mixer. Preferably the granules are treated with at least 1, more preferably at least 1.5, yet more preferably at least 2 wt % of water. Preferably, the granules are treated with no more that 15, more preferably no more than 10, yet more preferably no more than 8, and most preferably no more than 5 wt % of water It is highly preferred that water be contacted with the granules whilst the granules are under agitation. The granules may be agitated, for example, by using a simple vibrating belt. However, it is preferred that the water be contacted with the granules in any suitable mixer. Preferably the granules are treated with the water in a low shear mixer, such as, for example, a rotating bowl, a drum mixer or a fluidising bed. In a preferred embodiment, the water is contacted with the granules in a fluidising bed.

It is essential that little or no agglomeration takes place during the water addition step and that the conditions for water addition are suitably selected. For example, a fluid bed apparatus can be operated as a granulator (i.e. a "gas fluidisation apparatus") or simply as a mixing and/or drying fluidised bed apparatus in which very little or no agglomeration takes place.

The fact that little or no further agglomeration occurs in the low shear mixer during addition of the water can simply be ascertained by visual inspection. However, preferably, this is taken to mean that there is no significant reduction in the weight fraction of fines (as hereinbefore defined) and/or no significant increase in the weight fraction of coarse material (as hereinbefore defined). Significant reduction and significant increase preferably mean no more than 30% reduction and no more than 30% increase, respectively.

In a particularly preferred embodiment, the granulator, or the last granulator if more than one mixer is employed for granulation, is a fluidised bed and the water is contacted with the granules in a fluidised bed.

The granules can be treated in the same mixer as used for granulation or in a separate piece of equipment.

The water is preferably added as a spray into the mixer where contact takes place. During the addition process, the temperature in the mixer may be elevated. For example, if a fluidised bed is used the fluidising gas temperature may be elevated. Preferably, the water is at ambient temperature when sprayed on, although it may also be applied at an elevated temperature.

The water used may contain a small amount of other material dissolved or dispersed therein. However, it is preferred that any such material accounts for less than 5, more preferably less than 3, and yet more preferably less than 1 wt % of the water.

In a preferred embodiment, the water is substantially pure, i.e. any other materials present are an artefact of the water supply or source and nothing has been purposefully added.

Optional Processing Steps

As optional steps, after the granulation step, a layering step can be included and/or the granules can be dried and/or cooled. If such a step is employed, the granules may be treated with water prior to, during or after the optional processing step.

In a preferred embodiment, if a drying and/or cooling step is employed, it is preferred that the granules are treated with water either prior to or during the drying and/or cooling step.

The drying and/or cooling step can be carried out in any known manner, for instance in a fluid bed apparatus (drying and cooling) or in an airlift (cooling). Drying and/or cooling can be carried out in the same fluid bed apparatus as used in the granulation step and/or the water addition step simply by changing the process conditions employed as will be well-known to the person skilled in the art. If the granules are treated with water during the drying step, it is preferred that the granules are at least partially dried, then treated with water and finally drying completed.

It is particularly advantageous to carry out this type of water addition and drying process in a fluidised bed apparatus.

The process can be carried out either in a batchwise or continuous manner. In a preferred embodiment, the entire process is contnuous.

The Liquid Binder

The liquid binder can comprise one or more components of the granular detergent product. Suitable liquid components include anionic surfactants and acid precursors thereof, nonionic surfactants, soaps and there fatty acid precursors, water and organic solvents.

The liquid binder can also comprise solid components dissolved in or dispersed in a liquid component, such as, for example, inorganic neutralising agents and detergency builders. The only limitation is that with or without dissolved or dispersed solids, the liquid binder should be pumpable and capable of being delivered to the granulator in a fluid, including paste-like, form.

It is preferred that the liquid binder comprises an anionic surfactant. The content of anionic surfactant in the liquid binder may be as high as possible, e.g. at least 98 wt % of the liquid binder, or it may be less than 75 wt %, less than 50 wt % or less than 25 wt %. It may, of course constitute 5 wt % or less or not be present at all.

Suitable anionic surfactants are well-known to those skilled in the art. Examples suitable for incorporation in the liquid binder include alkylbenzene sulphonates, particularly linear alkylbenzene sulphonates having an alkyl chain length of $C_8$–$C_{15}$ primary and secondary alkyl sulphates, particularly $C_{12}$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Some or all of any anionic surfactant may be formed in situ in the liquid binder by reaction of an appropriate acid precursor and an alkaline material such as an alkali metal hydroxide, e.g. NaOH. Since the latter normally must be dosed as an aqueous solution, that inevitably incorporates some water. Moreover, the reaction of an alkali metal hydroxide and acid precursor also yields some water as a by-product.

However, in principle, any alkaline inorganic material can be used for the neutralisation but water-soluble alkaline inorganic materials are preferred. Another preferred material is sodium carbonate, alone or in combination with one or more other water-soluble inorganic materials, for example, sodium bicarbonate or silicate. If desired, a stoichiometric excess of neutralising agent may be employed to ensure complete neutralisation or to provide an alternative function, for example as a detergency builder, e.g. if the neutralising agent comprises sodium carbonate. Organic neutralising agents may also be employed.

Of course, if the liquid binder contains an acid precursor of an anionic surfactant, the acid precursor can be neutralised or neutralisabon completed in situ in the granulator by either contacting with a solid alkaline material or adding a separate liquid neutralising agent to the mixer and/or granulator.

The liquid acid precursor may be selected from linear alkyl benzene sulphonic (LAS) acids, alphaolefin sulphonic acids, internal olefin sulphonic acids, fatty acid ester sulphonic acids and combinations thereof. The process of the invention is especially useful for producing compositions comprising alkyl benzene sulphonates by reaction of the corresponding alkyl benzene sulphonic acid, for instance Dobanoic acid ex Shell. Linear or branched primary alkyl sulphates (PAS) having 10 to 15 carbon atoms can also be used.

In a preferred embodiment, the liquid binder comprises an anionic surfactant and a nonionic surfactant. The weight ratio of anionic surfactant to nonionic surfactant is in the range from 10:1 to 1:15, preferably from 10:1 to 1:10, more preferably 10:1 to 1:5. If the liquid binder comprises at least some acid precursor of an anionic surfactant and a nonionic surfactant, then the weight ratio of anionic surfactant, including the acid precursor, to nonionic surfactant can be higher, for example 15:1.

The nonionic surfactant component of the liquid binder may be any one or more liquid nonionics selected from primary and secondary alcohol ethoxylates, especially $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide). In a preferred embodiment the liquid binder is substantially non-aqueous. That is to say, the total amount of water therein is not more than 15 wt % of the liquid binder, preferably not more than 10 wt %. However, if desired, a controlled amount of water may be added to facilitate neutralisation. Typically, the water may be added in amounts of 0.5 to 2 wt % of the final detergent product. Typically, from 3 to 4 wt % of the liquid binder may be water as the reaction by-product and the rest of the water present will be the solvent in which the alkaline material was dissolved. The liquid binder is very preferably devoid of all water other than that from the latter-mentioned sources, except perhaps for trace amounts/impurities.

Alternatively, an aqueous liquid binder may be employed. This is especially suited to manufacture of products which are adjuncts for subsequent admixture with other components to form a fully formulated detergent product. Such adjuncts will usually, apart from components resulting from the liquid binder, mainly consist of one, or a small number of components normally found in detergent compositions, e.g. a surfactant or a builder such as zeolite or sodium tripolyphosphate. However, this does not preclude use of aqueous liquid binders for granulation of substantially fully formulated products. In any event, typical aqueous liquid binders include aqueous solutions of alkali metal silicates, water soluble acrylic/maleic polymers (e.g. Sokalan CP5) and the like.

The liquid binder may optionally comprise dissolved solids and/or finely divided solids which are dispersed therein. The only limitation is that with or without dissolved or dispersed solids, the liquid binder should be pumpable and sprayable at temperatures of 50° C. or greater or at any rate, 60° C. or greater e.g. 75° C. Preferably it is solid at below 50° C., preferably at 25° C. or less. The liquid binder is preferably at a temperature of at least 50° C., more preferably at least 60° C. when fed into the mixer or gas fluidisation granulator.

According to the present invention, liquid binders are considered readily pumpable if they have a viscosity of no greater than 1 Pa.s at a shear rate of 50 $s^{-1}$ and at the temperature of pumping. Liquid binders of higher viscosity may still in principle be pumpable, but an upper limit of 1 Pa.s at a shear rate of 50 $s^{-1}$ is used herein to indicate easy pumpability.

The viscosity can be measured, for example, using a Haake VT500 rotational viscometer. The viscosity measurement may be carried out as follows. A SV2P measuring cell is connected to a thermostatic waterbath with a cooling unit. The bob of the measuring cell rotates at a shear rate of 50

$s^{-1}$. Solidified blend is heated in a microwave to 95° C. and poured into the sample cup. After conditioning for 5 minutes at 98° C., the sample is cooled at a rate of +/−1° C. per minute. The temperature at which a viscosity of 1 Pa.s is observed, is recorded as the "pumpable temperature".

A definition of solid can be found in the Handbook of Chemistry and Physics, CRC Press, Boca Raton, Florida, 67th edition, 1986.

Structured Blends

In a preferred embodiment of this invention, the liquid binder contains a structurant and liquid binders which contain a structurant are referred to herein as structured blends. All disclosures made herein with reference to liquid binders apply equally to structured blends.

In the context of the present invention, the term "structurant" means any component which enables the liquid component to achieve solidification in the granulator and hence good granulation, even if the solid component has a low liquid carrying capacity.

Structurants may be categorised as those believed to exert their structuring (solidifying) effect by one of the following mechanisms, namely: recrystallisation (e.g. silicate or phosphates); creation of a network of finely divided solid particles (e.g. silicas or clays); and those which exert steric effects at the molecular level (e.g. soaps or polymers) such as those types commonly used as detergency builders. One or more structurants may be used.

Structured blends provide the advantage that at lower ambient temperatures they solidify and as a result lend structure and strength to the particulate solids onto which they are sprayed. It is therefore important that the structured blend should be pumpable and sprayable at an elevated temperature, e.g. at a temperature of at least 50° C., preferably of at least 60° C., and yet should solidify at a temperature below 50° C., preferably below 35° C. so as to impart its benefit.

The structurants cause solidification in the liquid binder component preferably to produce a blend strength as follows. The strength (hardness) of the solidified liquid component can be measured using an Instron pressure apparatus. A tablet of the solidified liquid component, taken from the process before it contacts the solid component, is formed of dimensions 14 mm in diameter and 19 mm in height. The tablet is then destroyed between a fixed and a moving plate. The speed of the moving plate is set to 5 mm/min, which causes a measuring time of about 2 seconds. The pressure curve is logged on a computer. Thus, the maximum pressure (at the moment of tablet breaking) is given and the E-modulus is calculated from the slope.

For the solidified liquid component, $P_{max}$ at 20° C. is preferably a minimum of 0.2 M Pa, e.g. from 0.3 to 0.5 M Pa. At 55° C., a typical range is from 0.05 to 0.25 M Pa. At 20° C., $E_{mod}$ for the liquid blend is preferably a minimum of 3 M Pa, e.g. from 5 to 10 M Pa.

The structured blend is preferably prepared in a shear dynamic mixer for premixing the components thereof and performing any neutralisation of anionic acid precursor.

Soaps represent one preferred class of structurant, especially when the structured blend comprises a liquid nonionic surfactant. In many cases it may be desirable for the soap to have an average chain length greater than the average chain length of the liquid nonionic surfactant but less than twice the average chain length of the latter.

It is very much preferred to form some or all of any soap structurant in situ in the liquid binder by reaction of an appropriate fatty acid precursor and an alkaline material such as an alkali metal hydroxide, e.g. NaOH. However, in principle, any alkaline inorganic material can be used for the neutralisation but water-soluble alkaline inorganic materials are preferred. In a liquid binder comprising an anionic surfactant and soap, it is preferred to form both the anionic surfactant and soap form their respective acid precursors. All disclosures made herein to formation of anionic surfactant by in situ neutralisaton in the liquid binder of their acid precursors equally apply to the formation of soap in structured blends.

If desired, solid components may be dissolved or dispersed in the structured blend. Typical amounts of ingredients in the essential structured blend component as % by weight of the structured blend are as follows:

- preferably from 98 to 10 wt % of anionic surfactant, more preferably from 70 to 30%, and especially from 50 to 30 wt %;
- preferably from 10 to 98 wt % of nonionic surfactant, more preferably from 30 to 70 wt %, and especially from 30 to 50 wt %;
- preferably from 2 to 30 wt % of structurant, more preferably from 2 to 20%, yet more preferably from 2 to 15 wt %, and especially from 2 to 10 wt %.

In addition to the anionic surfactant or precursor thereof, nonionic surfactant and structurant, the structured blend may also contain other organic solvents.

Particulate Material

The granular detergent product is prepared by granulating particulate material with liquid binder.

The particulate material may be powdered and/or granular. As such, the particulate material may be any component of the granular detergent product that is available in particulate form, although at least one component of the particulate material must be in the form of a hydratable salt. In preferred embodiment, the particulate material with which the liquid binder is admixed comprises a detergency builder.

Hydratable Salt

The particulate material that is granulated with the liquid binder must comprise a hydratable salt. The hydratable salt does not necessarily have to be present as starting material at the beginning of the granulation process, it may be added part way through the granulation process. Preferably, it is present as starting material.

The amount of hydratable salt added to the process is preferably sufficient to account for at least 5 wt %, more preferably at least 10 wt % of the granular detergent product. Preferably, the hydratable salt amounts to no more than 80 wt %, more preferably no more than 60 wt %, yet more preferably no more than 40 wt % of the granular detergent product.

Suitable hydratable salts, the use of which this invention has been found to benefit include phosphate, carbonate and citrate salts.

In a preferred embodiment, the hydratable salt is a detergency builder. More preferably, the hydratable salt is an inorganic phosphate builder, e.g. STPP.

A salt is considered to be hydratable if it is capable of bonding water in such a manner that activation energy is required to remove it.

Product

The present invention also encompasses a granular detergent product resulting from the process of the invention (before any post-dosing or the like). Granular detergent products according to the invention have a wide range of bulk densities depending to a large extent of the particular granulation process employed in step (i). The bulk density can range from 300 to 1200 g/l. Preferably, however, the granular detergent products of this process have a bulk density in the range 350 to 900 g/l, more preferably in the range 450 to 800 g/l.

The granular detergent products of the process of this invention are low in fines, possess good flow properties and have low UCT levels.

More particularly, the process of this invention provides granular detergent products with improved fines levels. Preferably, less than 10 wt % of the granules have a diameter of less 180 microns, more preferably less than 8 wt %, and most preferably less than 5 wt %.

The granular product is considered to be free flowing if it has a DFR of at least 80 ml/s. Preferably the granular products of this invention have DFR values of at least 80 ml/s, preferably at least 90 ml/s, more preferably at least 100 ml/s, and most preferably at least 110 mls.

The granular detergent product preferably has a UCT level, without any drying step being employed, of less than 1200 g, more preferably less than 1000 g. The granular detergent product preferably has a UCT level, after a drying step has been employed, of less than 600 g, more preferably less than 500 g.

Detergent Compositions and Ingredients

As previously indicated, a granular detergent product prepared by the process of the invention may itself be a fully formulated detergent composition, or may be a component or adjunct which forms only a part of such a composition. This section relates to final, fully formed detergent compositions.

The total amount of detergency builder in the final detergent composition is suitably from 10 to 80 wt %, preferably from 15 to 60 wt %. The builder may be present in an adjunct with other components or, if desired, separate builder particles containing one or more builder materials may be employed.

This invention is especially applicable to use where the particulate material comprises builders which are hydratable salts, preferably in substantial amounts such as at least 25% by weight of the solid component, preferably at least 10% by weight. Examples of such builders include inorganic phosphates and carbonates and certain organic builders such as citrates. Examples of suitable inorganic phosphate builders include sodium orthophosphate, pyrophosphate and tripolyphosphate.

Other inorganic builders that may be present include sodium carbonate, if desired in combination with a crystallisation seed for calcium carbonate as disclosed in GB-A-1 437 950. As mentioned above, such sodium carbonate may be the residue of an inorganic alkaline neutralising agent used to form an anionic surfactant in situ.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, aminopolycarboxylates such as nitrilotriacetates (NTA), ethylenediaminetetraacetate (EDTA) and iminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. The builder is preferably present in alkali metal salt, especially sodium salt, form.

Crystalline and amorphous aluminosilicate builders may also be used, for example zeolites as disclosed in GB-A-1 473 201; amorphous aluminosilicates as disclosed in GB-A-1 473 202; and mixed crystalline/amorphous aluminosilicates as disclosed in GB 1 470 250; and layered silicates as disclosed in EP-B-164 514.

Aluminosilicates, whether used as layering agents and/or incorporated in the bulk of the particles may suitably be present in a total amount of from 10 to 60 wt % and preferably an amount of from 15 to 50 wt % based on the final detergent composition. The zeolite used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicate of the P type having a silicone to aluminium ratio not exceeding 1.33, preferably not exceeding 1.15, and more preferably not exceeding 1.07.

The granular detergent compositions may contain, in addition to any anionic and/or nonionic surfactants of the liquid binder, one or more other detergent-active compounds which may be chosen from soap and non-soap anionic, cationic, nonionic, amphoteric and zwitterionic surfactants, and mixtures thereof. These may be dosed at any appropriate stage before or during the process. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds.

The detergent compositions may also contain a bleach system, desirably a peroxy bleach compound, for example, an inorganic persalt or organic peroxyacid, capable of yielding hydrogen peroxide in aqueous solution. The peroxy bleach compound may be used in conjunction with a bleach activator (bleach precursor) to improve bleaching action at low wash temperatures. An especially preferred bleach system comprises a peroxy bleach compound (preferably sodium percarbonate optionally together with a bleach activator), and a transition metal bleach catalyst as described and claimed in EP-A-458 397 and EP-A-509 787.

Usually, any bleach and other sensitive ingredients, such as enzymes and perfumes, will be post-dosed after granulation along with other minor ingredients.

Typical minor ingredients include sodium silicate; corrosion inhibitors including silicates; antiredeposition agents such as cellulosic polymers; fluorescers; inorganic salts such as sodium sulphate, lather control agents or lather boosters as appropriate; proteolytic and lipolytic enzymes; dyes; coloured speckles; perfumes; foam controllers; and fabric softening compounds. This list is not intended to be exhaustive.

Optionally, a "layering agent" or "flow aid" may be introduced at any appropriate stage in the process of the invention. This is to improve the granularity of the product, e.g. by preventing aggregation and/or caking of the granules. Any layering agent flow aid is suitably present in an amount of 0.1 to 15 wt % of the granular product and more preferably in an amount of 0.5 to 5 wt %.

Suitable layering agents/flow aids include crystalline or amorphous alkali metal silicates, aluminosilicates including zeolites, citrates, Dicamol, calcite, diatomaceous earths, silica, for example precipitated silica, chlorides such as sodium chloride, sulphates such as magnesium sulphate, carbonates such as calcium carbonate and phosphates such as sodium tripolyphosphate. Mixtures of these materials may be employed as desired.

Powder flow may also be improved by the incorporation of a small amount of an additional powder structurant, for example, a fatty acid (or fatty acid soap), a sugar, an acrylate or acrylate/maleate polymer, or sodium silicate which is suitably present in an amount of from 1 to 5 wt %.

In general, additional components may be included in the liquid binder or admixed with the solid starting material at an appropriate stage of the process. However, solid components can be post-dosed to the granular detergent product.

The granular detergent composition may also comprise a particulate filler (or any other component which does not contribute to the wash process) which suitably comprises an inorganic salt, for example sodium sulphate and sodium chloride. The filler may be present at a level of 5 to 70 wt % of the granular product.

The invention will now be explained in more detail by way of the following non-limiting examples.

EXAMPLES

Example 1

In Example 1, Control 1 and Comparative Examples A and B, the following base powder formulation was produced in a gas fluidisation granulation process:

| | |
|---|---|
| Sodium-LAS | 24 wt % |
| Sodium carbonate | 32 wt % |
| STPP | 32 wt % |
| Zeolite 4A | 10 wt % |
| Water | 2 wt % |

LAS acid was sprayed onto the fluidising solids in a gas fluidisation chamber using an air-assisted atomiser (SUE25, ex Spraying Systems). The fluidising gas operated at a superficial air velocity of around 0.8 $ms^{-1}$ air and temperature of 23° C.

Once granulation was complete (after about 5 minutes), the fluidising powder was either sprayed with water or an aqueous solution of sodium silicate or not sprayed at all as follows:

| | |
|---|---|
| Example 1: | 4 wt % of water |
| Comparative A: | 2 wt % of aqueous sodium silicate |
| Comparative B: | 4 wt % of aqueous sodium silicate |
| Control 1: | Nothing |

The concentration of the aqueous solution was 46–48 wt % sodium silicate. In one set of experiments, the powder was collected at this stage. In another set of experiments, the powder was subsequently dried in a fluid bed drier at 70° C. for 15 minutes. Various properties of the powders were measured and the results recorded in Table 1.

The results clearly demonstrate that spraying on a small amount of water according to the process of the invention produces a powder with good a UCT value which, this being at least as good as that obtained by spraying on a silicate solution.

Although drying is not essential to obtain a good, free-flowing powder, in order to obtain very low UCT levels, it is preferable that the powder undergoes a drying step. After drying, the UCT level of the powder treated with water is at least as good as that achieved by spraying on of a silicate solution and drying.

TABLE 1

| | | Exp 1 | Cont 1 | Exp A | Exp B |
|---|---|---|---|---|---|
| Liquid | | Water | Nil | Aqu. Soln | Aqu. Soln |
| added | Wt % | 4 | Nil | 2 | 4 |
| Non- | BD (g/l) | 548 | 481 | 513 | 493 |
| Dried | UCT (g) | 1150 | 2150 | 900 | 1150 |
| Product | DFR (ml/min) | 139 | 141 | 134 | 132 |
| Dried | BD (g/l) | 615 | 539 | 581 | 577 |
| Product | UCT (g) | 300 | 650 | 300 | 200 |
| | DFR (ml/min) | 142 | 138 | 138 | 137 |

It was evident from visual inspection that no further agglomeration had occurred during the water spray-on step.

What is claimed is:

1. A process for preparing a granular detergent product comprising:

(a) granulating, in two or more successive mixers, a particulate material comprising a hydratable salt with a liquid binder to obtain granules of the detergent product having complete granulation;

(b) wherein the second or final mixer is a fluidized bed, and the granules are treated in the fluidized bed with from 0.5 to 20 wt % of water, based on the total amount of untreated granules, in such a manner that little or no further agglomeration takes place, the water comprising less than 5%, by weight of water, of any material dissolved or dispersed therein.

2. The process of claim 1, in which the granules are treated with from 1 to 15 wt % of water.

3. The process of claim 1, in which the water is sprayed onto granules which are under agitation.

4. The process of claim 1, in which the granules are dried and/or cooled.

5. The process of claim 4, in which the granules are treated with water either prior to or during drying and/or cooling in the fluidized bed.

6. The process of claim 1, in which the hydratable salt is a detergency builder.

7. The process of claim 1, in which the hydratable salt is a phosphate, carbonate or citrate.

* * * * *